US009131784B2

(12) United States Patent
Krause

(10) Patent No.: US 9,131,784 B2
(45) Date of Patent: Sep. 15, 2015

(54) CRIB/CRADLE SLEEP SYSTEM

(71) Applicant: Suki Moon LLC, Hood River, OR (US)

(72) Inventor: Gwendelyn Mary Krause, Hood River, OR (US)

(73) Assignee: Suki Moon LLC, Hood River, OR (US)

( * ) Notice: Subject to any disclaimer, the term of this patent is extended or adjusted under 35 U.S.C. 154(b) by 0 days.

(21) Appl. No.: 14/011,474

(22) Filed: Nov. 5, 2013

(65) Prior Publication Data

US 2014/0059777 A1 Mar. 6, 2014

Related U.S. Application Data

(60) Provisional application No. 61/743,161, filed on Aug. 28, 2012.

(51) Int. Cl.
*A47D 15/00* (2006.01)
*A47C 21/08* (2006.01)

(52) U.S. Cl.
CPC ..... *A47D 15/00* (2013.01); *A47D 15/008* (2013.01); *A47C 21/08* (2013.01)

(58) Field of Classification Search
CPC ... A47D 15/008; A47D 15/001; A47D 15/00; A47D 15/003; A61G 2007/0522; A61G 7/0525; Y10S 5/946; A47C 21/02; A47C 21/026; A47C 21/08; A47G 9/0246
USPC ..... 5/663, 93.1, 424, 427, 946
See application file for complete search history.

(56) References Cited

U.S. PATENT DOCUMENTS

| | | | | | |
|---|---|---|---|---|---|
| 3,148,387 | A | | 9/1964 | Sarnie, Jr. et al. | |
| 3,619,824 | A | * | 11/1971 | Doyle | 5/143 |
| 4,873,734 | A | * | 10/1989 | Pollard | 5/425 |
| 4,890,346 | A | * | 1/1990 | Rist | 5/658 |
| 4,922,565 | A | | 5/1990 | Blake | |
| 5,542,135 | A | * | 8/1996 | Ozrovitz et al. | 5/424 |
| 5,806,112 | A | * | 9/1998 | Harms | 5/93.1 |
| 5,937,458 | A | * | 8/1999 | DeRosa | 5/424 |
| 5,960,493 | A | * | 10/1999 | Rhey et al. | 5/424 |
| 6,131,216 | A | * | 10/2000 | Pine | 5/93.1 |
| 6,243,895 | B1 | * | 6/2001 | Amin | 5/498 |
| 6,347,422 | B2 | * | 2/2002 | Heavrin | 5/663 |
| 6,408,463 | B1 | * | 6/2002 | Palacio | 5/424 |
| 6,438,775 | B1 | * | 8/2002 | Koenig | 5/424 |
| 6,481,030 | B2 | * | 11/2002 | Bravo et al. | 5/425 |
| 6,487,735 | B1 | * | 12/2002 | Jacques et al. | 5/424 |
| 6,848,130 | B1 | | 2/2005 | Wilson | |
| 7,213,282 | B1 | * | 5/2007 | Wojtowicz | 5/93.1 |

(Continued)

*Primary Examiner* — Nicholas Polito
*Assistant Examiner* — David R Hare
(74) *Attorney, Agent, or Firm* — Seed IP Law Group PLLC

(57) ABSTRACT

A bedding assembly for use with a mattress, the assembly including a circumscribing padding sized and shaped to extend from or rest on top of a top perimeter surface of the mattress, the padding having one or more contiguous sections, each section having a vertical outer surface positioned adjacent to sidewalk of the mattress, a horizontal bottom surface adjacent the to surface of the mattress, and an angled surface extending from the outer surface to the bottom surface, and a cover sized and shaped to secure the padding sections together in a shape that circumscribes a central portion of the mattress, and a fitted sheet sized and shaped to hold the padding and cover on the mattress.

12 Claims, 8 Drawing Sheets

(56) References Cited

U.S. PATENT DOCUMENTS

| | | | | |
|---|---|---|---|---|
| 7,757,320 | B2 * | 7/2010 | Lord et al. | 5/655 |
| 7,774,874 | B2 * | 8/2010 | Pressler | 5/424 |
| 8,082,612 | B2 | 12/2011 | Saunders | |
| 8,161,584 | B1 * | 4/2012 | Del Rio | 5/424 |
| 2004/0064889 | A1 * | 4/2004 | Diak/Ghanem | 5/482 |
| 2005/0071921 | A1 * | 4/2005 | Risk, Jr. | 5/425 |
| 2006/0075555 | A1 * | 4/2006 | Komisar | 5/424 |
| 2010/0154127 | A1 | 6/2010 | Walter et al. | |

* cited by examiner

CRIB/CRADLE SLEEP SYSTEM

BACKGROUND

1. Technical Field

The present disclosure is directed to sleep systems and, more particularly, to mattresses and bedding for infants and toddlers to be used in crib and cradle safety sleep systems.

2. Description of the Related Art

Cribs and cradles are utilized by infants or young children during sleep and nap times as well as for resting while awake. A typical crib has a base, a soft mattress resting on the base, and side rails surrounding the mattress to keep an infant from falling off the mattress. One or both side rails have top and bottom rails with vertical slats extending there between. These side rails are usually configured to raise and lower to facilitate placing and removing a child from the crib and changing the bedding and, at times, the mattress. However, the side rails of a crib can often pose dangers for young children, such as hitting their heads on the hard surface or getting limbs stuck between individual vertical slats. As a result of these dangers, crib bumpers have become popular to act as a buffer between a child and the side rails.

Many people find crib bumpers necessary for one of three reasons: to protect a child from the hard surfaces of the crib or cradle, to prevent a child's limbs from extending through the slats resulting in strain or injury, or to simply provide an environment in which a child can have a more restful sleep.

Traditional crib and cradle bumpers create a "wall" that lines the inside perimeter of the bed. These bumpers block the child's access to the vertical slats and the space in between each vertical slat. Unfortunately, these bumpers can also block airflow to the child, especially young infants who can be smothered or tangled in the flexible ties used to hold the bumper to the side rails and end boards of the crib. This style of crib bumper has generally been made of a continuous, soft, quilted pad that is fastened to the vertical rails of the crib by ties similar to shoe laces. There are a number of reasons why this is not safe for a child. First, the pad does not allow for proper airflow to the child and a child can suffocate if their airway is blocked by the soft pad (at a young age, children do not have the instinct to move away when their airway is blocked). Second, because the pads are secured to the railings instead of the mattress by the ties, children can get their faces or limbs wedged between the bumper and the mattress causing injury or suffocation. Finally, these pads are typically secured to the rails with some type of fastener, generally ties, that do not hold the bumper tightly to the rails and slats, which can pose a strangulation or choking hazard for children.

There are also new types of "wall" bumpers made of mesh. These do allow for airflow while keeping a child's limbs from becoming stuck in the side rails, but they do not provide any protection from the hard surfaces of the rails or crib. This could result in injury to the child or, at minimum, could wake a child if they bump too hard into the sides of the crib or cradle. One example of a mesh bumper can be seen in U.S. Pat. No. 8,161,584, which uses a mesh means at the base of the bumper where the bumper meets the mattress. Additionally, this system uses a fastening device to attach the mesh to the fitted sheet. This can either be in direct contact with a child, possibly resulting in injury, or be can lead to the child being covered with a "flap," leading to suffocation.

Another solution has been to wrap each vertical slat individually. One example of such a bumper can be seen in published Patent Application WO 2009117180. Although this method provides protection from the hard, internal surfaces of the crib and allows for airflow, it does not prevent a child's limbs from extending through the vertical rails. This could cause injury or allow a child to wake from restful sleep when turning or changing positions in the crib or cradle.

One other proposed solution can be seen in U.S. Pat. No. 7,774,874, which uses triangular bumpers around the inside perimeter of the crib or cradle. However, this design still poses several potential safety hazards. A child can easily get caught underneath the device because it rests directly on top of the mattress without being secured to the mattress in any way. If a child accidentally places their head or limbs under the bumpers, they could suffocate or sustain injuries. In addition, the bumper is attached via cords, snaps or some kind of tie to the rails of the bed, which present a significant choking or strangulation hazard to children.

Accordingly, there is a need for a protective system for cribs, cradles and toddler beds that does not pose any significant hazards or dangers to a child, and keeps the child centered in the safe middle section of the bed.

BRIEF SUMMARY

The present disclosure is directed to bedding and bedding systems for use with infants and young children. In accordance with one implementation of the present disclosure, a padding system is provided for use with a mattress, the mattress having a top surface, a bottom surface, a circumscribing sidewall defining a thickness, and a top surface perimeter. The padding system includes a padding assembly having a length for placement along at least part of the perimeter of the top surface of the mattress. The padding assembly has a bottom padding surface, a back padding surface, and an angled padding surface connecting the bottom padding surface to the back padding surface. The padding system also includes a padding cover having a continuous top surface, the padding cover sized and shaped to at least partially cover the padding assembly, and to hold the padding assembly in a geometric shape. The padding cover includes a central cover portion sized and shaped to and cover at least a portion of the top surface of the mattress and the inner padding surface, a side cover portion connected to the central cover portion and sized and shaped to at least partially wrap around the padding assembly, and releasable cover fasteners structured to releasably secure the side cover portion and the padding assembly together. The padding system further includes a fitted sheet sized and shaped to hold the padding assembly and the padding cover to the mattress. The fitted sheet has a padding covering portion sized and shaped to cover the padding cover, and a mattress covering portion having a first sheet part extending from the padding covering portion and sized and shaped to cover the circumscribing sidewall of the mattress, and a second sheet part extending from the first sheet part, and sized and shaped to at least partially cover the bottom surface of the mattress.

In accordance with another implementation of the present disclosure, a bedding assembly is provided for a mattress having a top surface with a surface area, which defines a perimeter of the mattress, and a bottom surface. The bedding assembly includes a padding sized and shaped to rest on the top surface of a mattress and be secured around the perimeter of the mattress, the padding having first, second, third, and fourth padding sections. The bedding assembly further includes a cover having a continuous top surface and is sized and shaped to enclose the padding and cover the surface area of the mattress. The cover includes a first padding wrap sized and shaped to at least partially enclose the first section of the padding, a second padding wrap sized and shaped to at least partially enclose the second section of the padding, a third padding wrap sized and shaped to at least partially enclose a third section of the padding, and a fourth padding wrap sized and shaped to at least partially enclose a fourth section of the padding. A center section is connected to the first padding wrap, the second padding wrap, the third padding wrap and the fourth padding wrap, the center section sized and shaped to securely hold the first padding wrap, the second padding wrap, the third padding wrap and the fourth padding wrap together.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed implementations. However, one skilled in the relevant art will recognize that the present disclosed implementations may be practiced without one or more of these specific details or with other methods, components, materials, etc. In other instances, well-known structures or components or both that are associated with the environment of the present disclosure, including but not limited to the construction of the crib frame, bed frame, and mattresses have not been shown or described in order to avoid unnecessarily obscuring descriptions of the implementations.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation.

Figure 1:
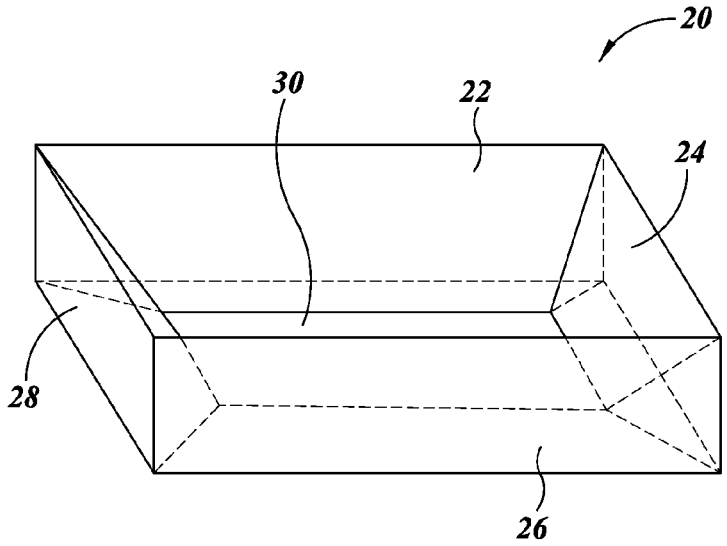
FIG. 1 is an isometric view of a bedding system according to one implementation of the present disclosure.
Figure 8:
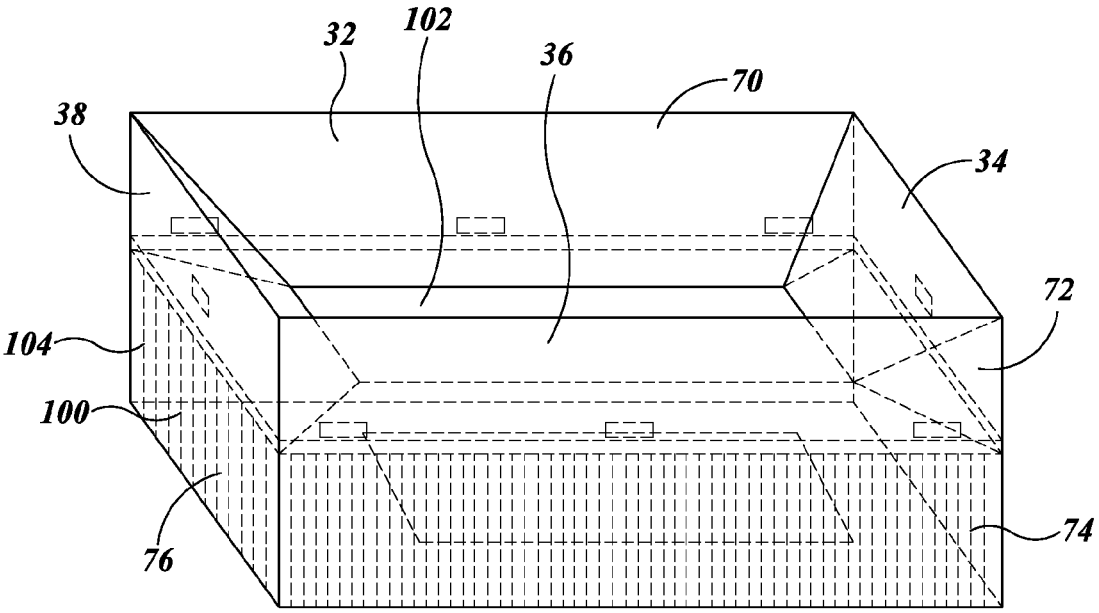
FIG. 8 shows the bedding system of FIG. 7 with hidden lines showing the mattress and padding.
Figure 9:
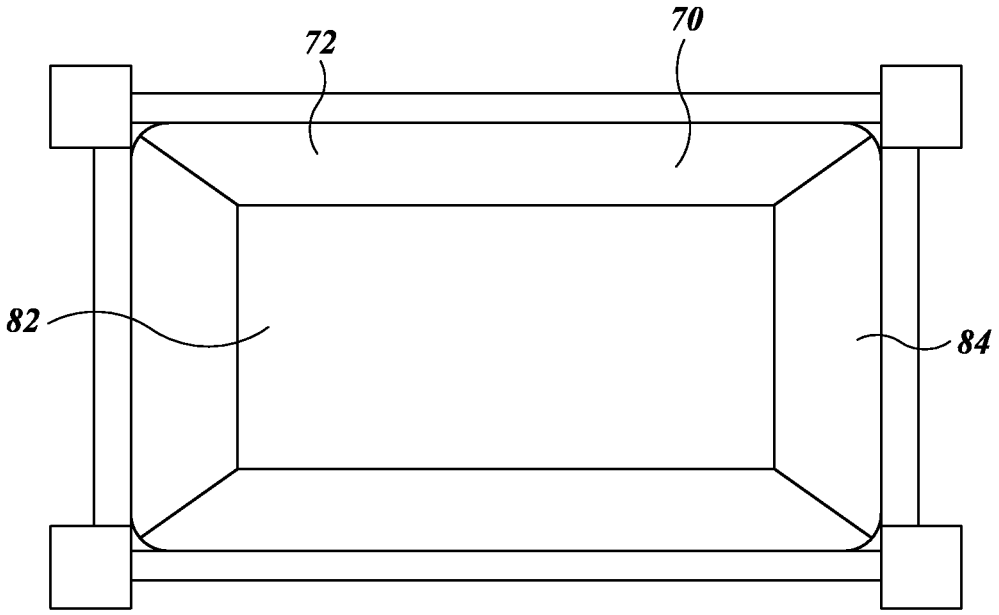
FIG. 9 is a top view a bedding system in a crib according to one implementation of the present disclosure.
Figure 10:
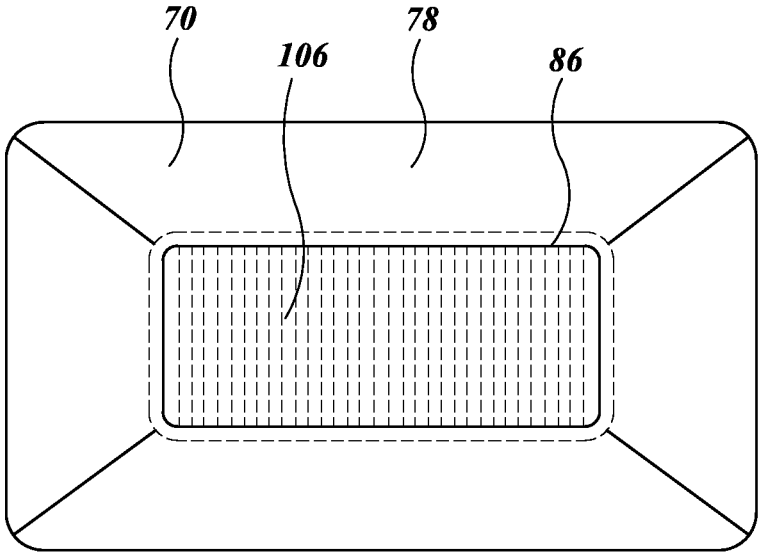
FIG. 10 is a bottom view of a bedding system with a fitted sheet according to one implementation of the present disclosure.

FIG. 1 shows a bedding assembly 20 according to one implementation of the present disclosure. The bedding assembly 20 includes a first side 22, a second side 24, a third side 26, a fourth side 28, and a center 30. The sides 22, 24, 26 and 28 are generally sloped upwards and outwards from the center 30. An infant is placed on the center 30 to sleep, and the sides 22, 24, 26 and 28 help to keep the infant positioned in the center 30 of the bedding system 20 and prevent them from falling off while sleeping. The bedding assembly 20 is designed to keep a child within the safety of the center 30 of a crib or cradle without any devices or parts that a child can get wedged under, become tangled in, or choke on. It is to be understood that the bedding assembly 20 can be formed to be with a mattress 100 (shown in FIG. 8) or mattress-boxspring combination or formed separate from the mattress 100. The system may also include the frame or crib that supports the mattress.

Figure 2:
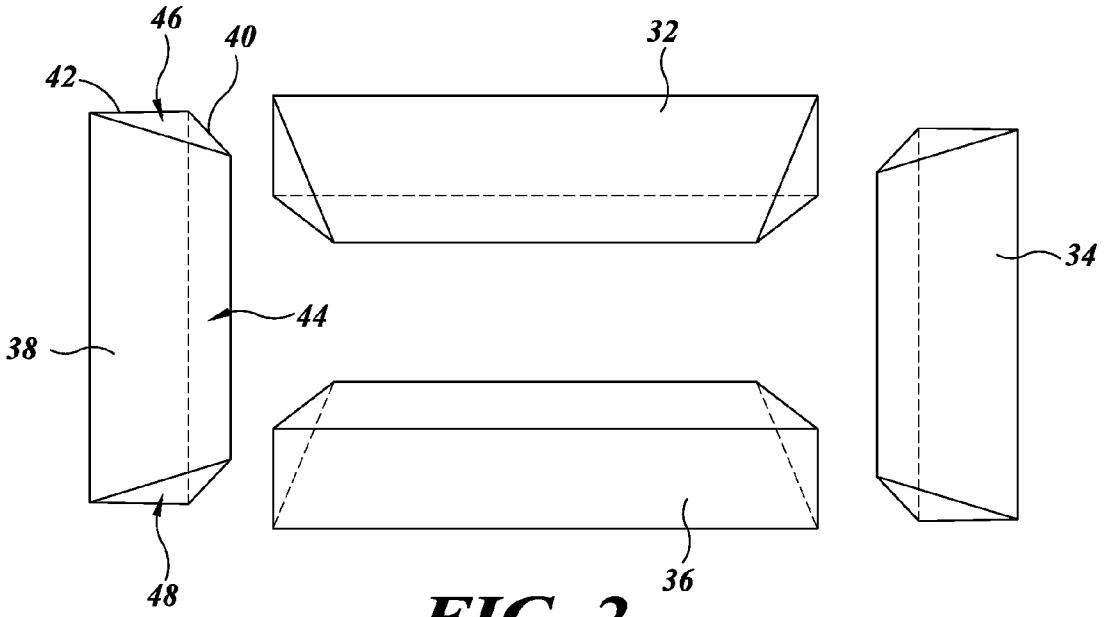
FIG. 2 shows the padding of the bedding system of FIG. 1.

FIG. 2 shows a further aspect of the bedding assembly 20 to include a first padding 32, a second padding 34, a third padding 36 and a fourth padding 38. It is to be appreciated that the individual padding sections 32, 34, 36, 38 can be connected together to form a unitary elongate padding or a padding formed in a geometric shape, such as the traditional rectangular shape of a mattress. As such it can be easily placed around the perimeter of a mattress top on which it is used.

However, in a preferred implementation, the padding is formed of the four sections 32, 34, 36 and 38 that are placed or formed in the sides 22, 24, 26 and 28 of the bedding assembly or system, thus providing a supporting structure for the sides. The contoured shape of the padding allows for easy airflow to the child, and prevents the sides 22, 24, 26 and 28 from collapsing on the child, which can lead to suffocation.

In another contemplated implementation of the present disclosure, the bedding system 20 only has two sides 22 and 26. In this implementation, the bedding system 20 positions paddings 32 and 36 on the top surface of the mattress 100, but does not have the paddings 34 and 38 adjacent to the headboard or footboard of the crib or cradle.

The padding 32, 34, 36, 38 is made of any suitable soft, protective material, such as foam. Preferably, the padding 32, 34, 36, 38 is made of food grade polyethylene in order to be less toxic and easily wiped clean. Food grade polyethylene does not produce trapped gasses like other foam products do, which may be dangerous to a child.

Figure 4:
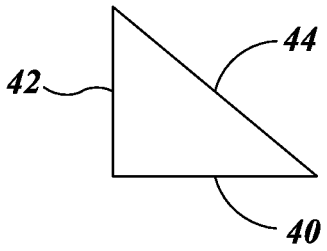
FIG. 4 is a side view of a padding of a bedding system formed in accordance with the present disclosure.

Each of the paddings 32, 34, 36 and 38 has a bottom surface 40, a back surface 42, an angled surface 44 connecting the bottom surface 40 and the back surface 42, and first and second side surfaces 46 and 48. Each padding 32, 34, 36 and 38 preferably has a triangular cross sectional configuration, as shown in FIG. 4. The angle between the bottom surface 40 and the angled surface 44 can be any angle sufficient to keep a child away from the railing, while still allowing adequate airflow to the child. Preferably, the angle is between 20 degrees and 70 degrees. The triangular shape of the paddings helps to ensure that there are no gaps or air pockets which a child might become stuck in, while still allowing air to easily flow into the crib.

The padding length from the first side surface 46 to the second side surface 48 can be any length appropriate to fit in a crib, cradle or toddler bed. Preferably, the length from side surface 46 to side surface 48 of paddings 32 and 36 is between 45" and 80"; and the length from side surface 46 to side surface 48 of paddings 34 and 38 is between 25" and 45". The width of the bottom surface 40, as measured from the back surface 42 to the angled surface 48, can be any length appropriate to keep a child safely secured in the center of the bedding assembly 20. Preferably, the width of the bottom surface 40 is between 4" and 6". The height of the back surface 42 can be any length appropriate to protect an infant or child from hitting the side rails of a crib or cradle or from falling out of a bed. Preferably, the height of the back surface 42 is between 3" and 6".

Figure 3:
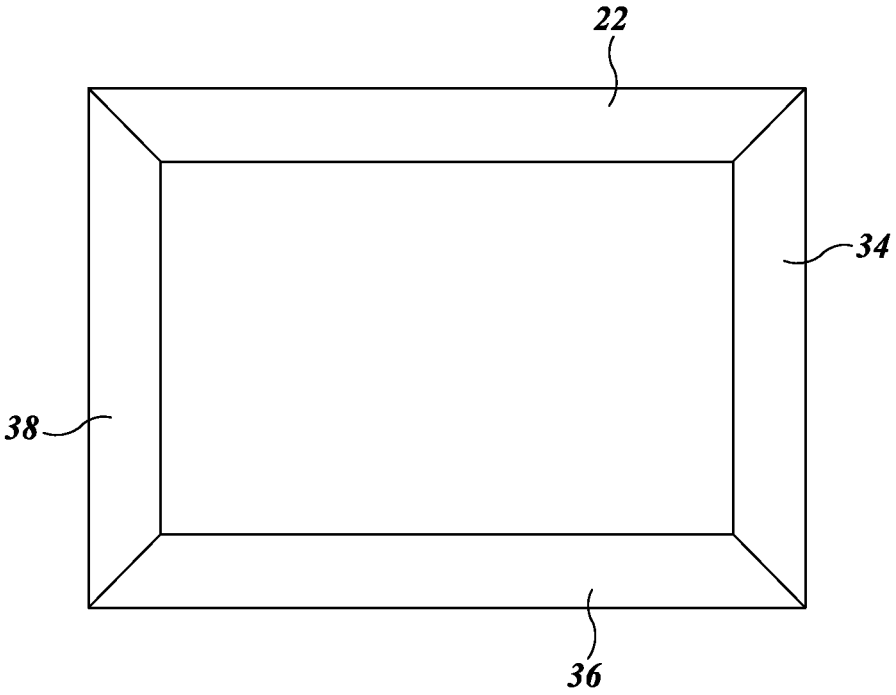
FIG. 3 is a top view of a padding of a bedding system formed in accordance with the present disclosure.

FIG. 3 shows the paddings 32, 34, 36 and 38 fitting together to form a rectangular shape having approximately the same outer perimeter dimensions as the top of the mattress with which the bedding assembly 20 will be used. As shown in FIG. 1, the bottom surface 40 of all paddings 32, 34, 36, 38 is placed downward, with the back surface 42 being vertical and the angled surface 44 angled inwardly toward the center of the crib. The side surface 46 of each padding 32, 34, 36, and 38 touches the side surface 48 of one other padding.

FIG. 4 is a side view of one of the paddings 32, 34, 36, 38, showing the face of the side surface 48, and a profile view of the padding.

Figure 5:
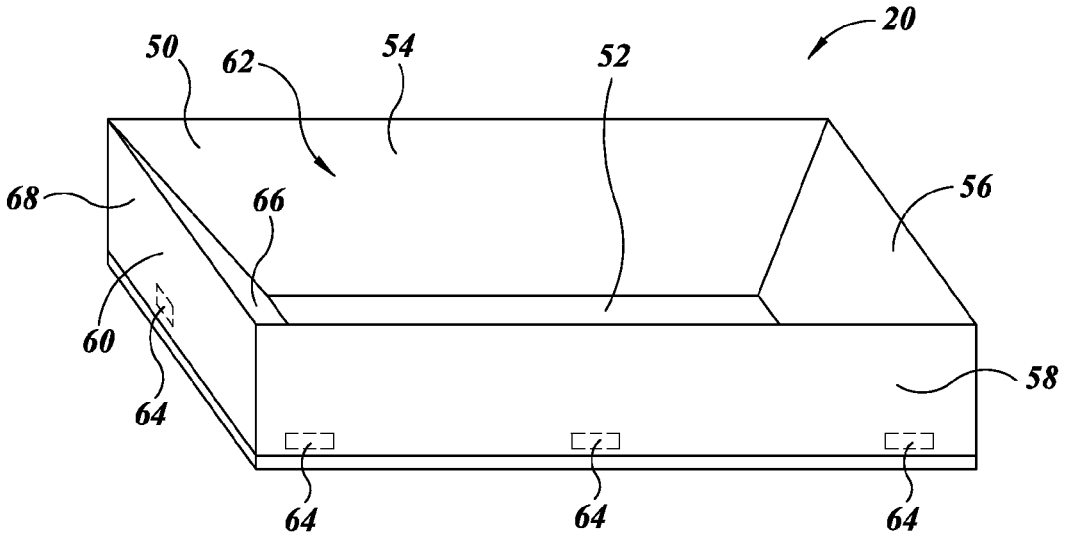
FIG. 5 shows a bedding system with attachment points of a cover according to one implementation of the present disclosure.
Figure 6:
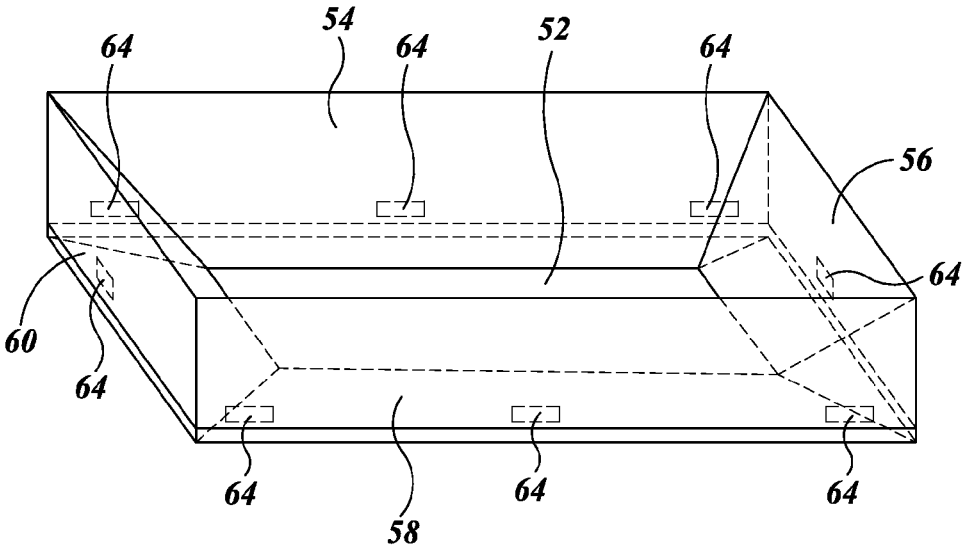
FIG. 6 shows the bedding system of FIG. 5 with hidden lines showing the padding and attachment points of a cover according to one implementation of the present disclosure.
Figure 7:
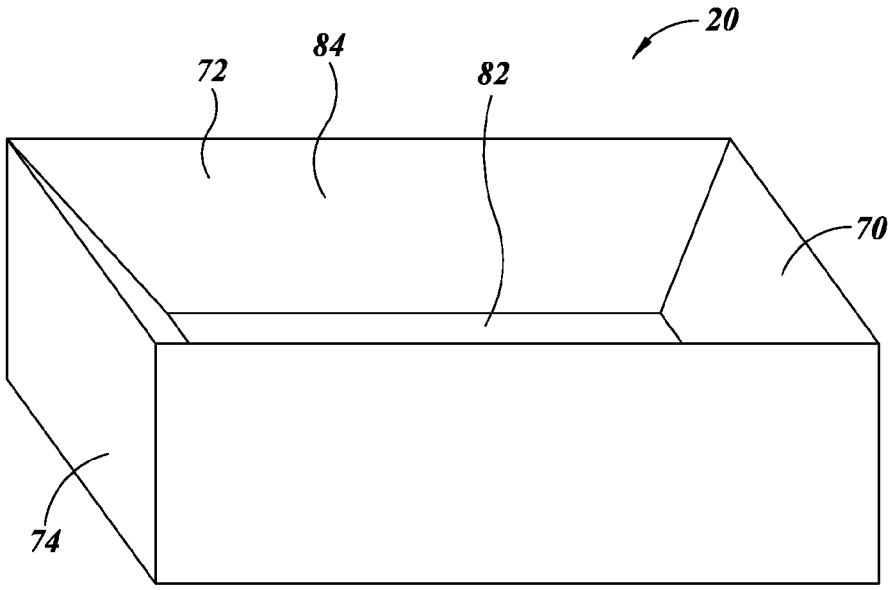
FIG. 7 is a bedding system with a fitted sheet according to one implementation of the present disclosure.

FIGS. 5 and 6 show a cover 50 of the bedding assembly 20. The paddings 32, 34, 36 and 38 are contained within the cover 50, which securely fastens all paddings 32, 34, 36 and 38 together. The cover 50 provides a single, continuous surface 62 for the entire bedding assembly 20, preventing a child from becoming trapped under the paddings. The cover 50 is made up of a center piece 52, a first padding wrap 54, a second padding wrap 56, a third padding wrap 58 and a fourth padding wrap 60. Each of the padding wraps 54, 56, 58 and 60 are connected to the center piece 52 so that the padding wraps and the center piece 52 have a single, continuous top surface 62 when the cover 50 is fastened around the paddings 32, 34, 36 and 38.

The padding wraps 54, 56, 58 and 60 each have a padding covering portion 66 extending from the center piece 52, and a side covering portion 68 extending from the padding covering portion. The padding wraps 54, 56, 58, and 60 contain fasteners 64 that are used to secure the padding wraps around their respective paddings 32, 34, 36 and 38. Preferably, the fasteners 64 are connected to the side cover portion 68 in order to keep the fasteners 64 on the outside of the system 20 and away from the child. According to one implementation, the padding wraps 54, 56, 58 and 60 fully enclose their respective paddings 32, 34, 36 and 38.

In another implementation, the padding wraps 54, 56, 58 and 60 partially enclose the paddings 32, 34, 36 and 38, leaving the bottom surface 40 of each padding uncovered. The fasteners 64 of the cover are preferably hook and loop fasteners, or any other suitable releasable fastener, and are positioned on all four sides of the cover. Preferably, there are eight sets of hook and loop fasteners stitched to the perimeter of the cover measuring approximately 1"×1.5" each. Other fasteners may include snaps or zippers, but will preferably face the railing so nothing hard can be felt while lying on the bedding system.

The cover 50 can be made of any suitable fabric to securely wrap the paddings, such as cotton. According to one implementation, the cover is made of 100% organic cotton. The weight of the fabric is preferably thick and durable enough to contain the paddings 32, 34, 36 and 38 and keep them in place, giving the bedding assembly 20 structure. Preferably the fabric used for the cover does not stretch, thereby giving more support to the bedding assembly 20. The cover 50 is sewn such that the padding wraps 54, 56, 58 and 60 fit tightly over the paddings 32, 34, 36 and 38 when they are wrapped around the paddings, preventing the paddings from slipping or moving. According to one implementation, the cover also protects the mattress from spills and stains by placing a rubber layer on the center piece 52. This is an added convenience for the consumer, as a separate mattress pad or protector does not have to be purchased. The cover 50 can be easily removed for laundering.

FIGS. 7-10 show another implementation of the bedding assembly 20 described above used in conjunction with a fitted sheet 70. The fitted sheet 70 is sized and shaped to at least fit over and preferably enclose or encompass the paddings 32, 34, 36 and 38, the cover 50, and the mattress 100 on which the bedding assembly 20 rests. The fitted sheet 70 includes a padding covering portion 72 and a mattress covering portion 74.

The padding covering portion 72 of the fitted sheet 70 is sized and shaped to fit over the center 30 and over the paddings 32, 34, 36 and 38. The padding covering portion 72 is sewn such that it has a center portion 82 that lies over the top surface 102 of the mattress 100, and a perimeter portion 84 that circumscribes the center portion 82 and fits over the paddings 32, 34, 36 and 38. The mattress covering portion 74 of the fitted sheet 70 extends from the padding covering portion to cover a sidewall 104 and a bottom surface 106 of the mattress 100. The mattress covering portion 74 has a first sheet part 76 that covers the sidewall 104 of the mattress 100, and a second sheet part 78 extending inwardly from the first part 76 to enclose at least part of the bottom surface 106 of the mattress, forming an opening 86 on the fitted sheet 70.

The fitted sheet 70 keeps the sleeping environment clean and clear of any internal parts that a child could potentially be entangled in, causing strangulation or suffocation. The opening 86 for removing the fitted sheet 70 is completely under the mattress and out of reach of the child. The sheet 70 is kept secure by elastic stitched in the opening 86 or any other suitable method. In one implementation, the sheet is made of 100% organic cotton, however any suitable fabric may be used. The fitted sheet 70 has a fabric that is preferably smooth and soft in surface texture making it a comfortable sleeping surface.

Figure 11:
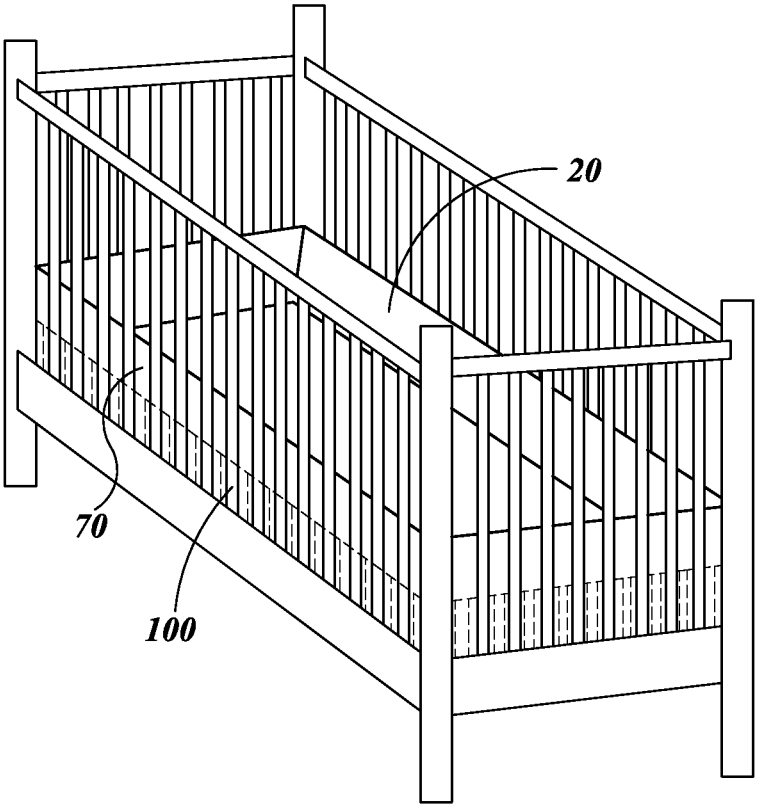
FIG. 11 is an isometric view of a bedding system in a crib according to one implementation of the present disclosure.
Figure 12:
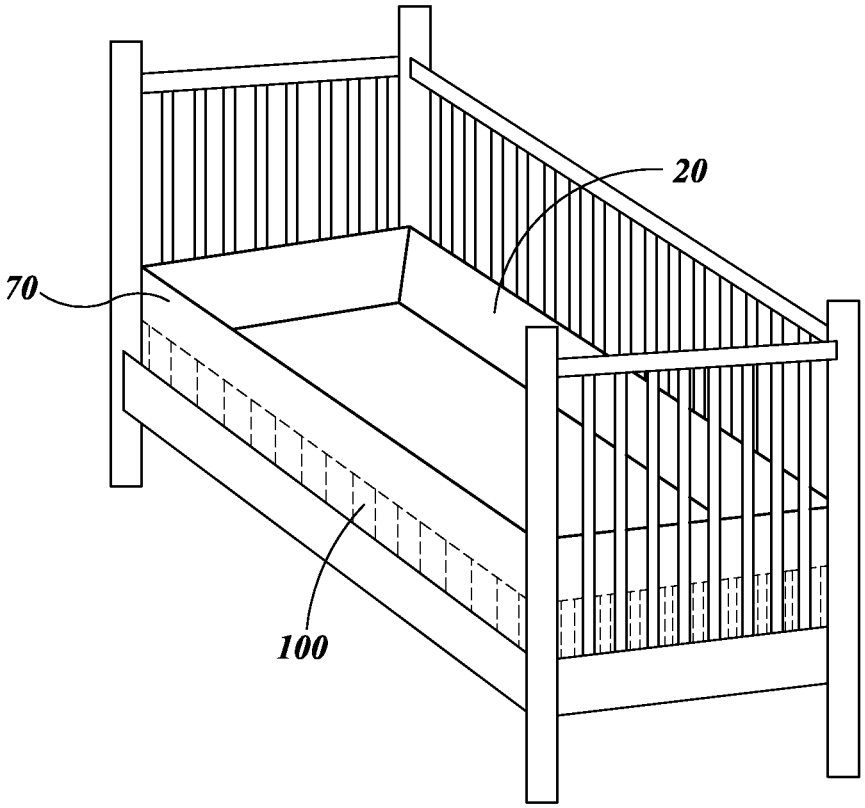
FIG. 12 is an isometric view of a bedding system formed in accordance with the present disclosure in a crib with one side rail of the crib removed.
Figure 13:
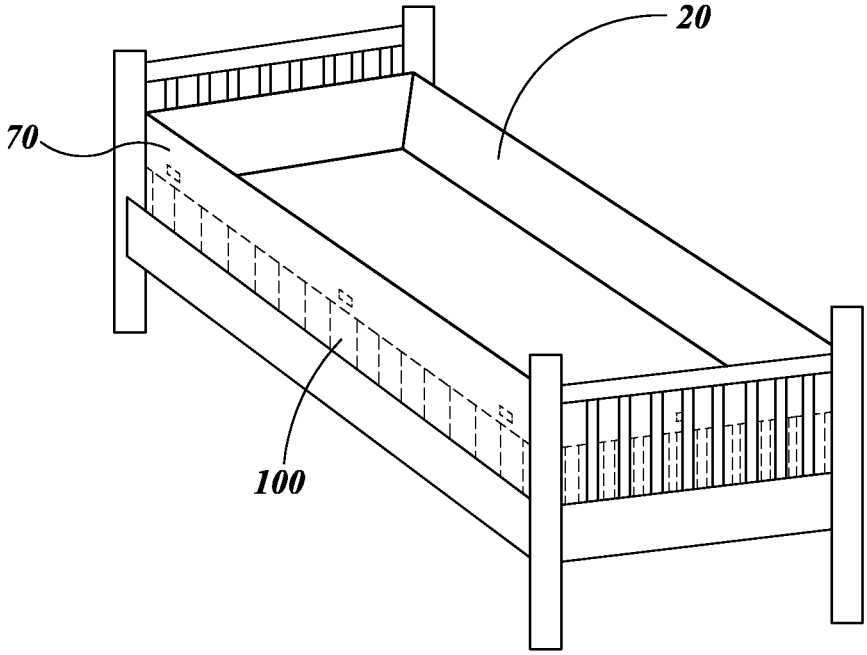
FIG. 13 is an isometric view of a bedding system in a toddler bed according to one implementation of the present disclosure.

FIGS. 11-13 show the bedding assembly 20 being used on a variety of different bed types, allowing the bedding assembly 20 to be used when a child is transitioning into larger bed by sleeping in a convertible crib or toddler bed. As long as a standard mattress is used in the bed, the fitted sheet 70 will securely fasten the bedding assembly 20 to the mattress even when no railing or other side guards are used. When used in a toddler bed or a convertible crib, the bedding assembly 20 will help to prevent a child from rolling out of bed. This lengthens the time and use of the implementation making it multi-functional and a more convenient purchase for the consumer.

The various implementations described above can be combined to provide further implementations. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the implementations can be modified, if necessary to employ concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A padding system for use with a mattress, the mattress having a top surface, a bottom surface, a circumscribing sidewall defining a thickness, and a top surface perimeter, the system comprising:

a padding assembly having a length for placement along at least part of the perimeter of the top surface of the mattress, including:

a bottom padding surface;

a back padding surface; and an angled padding surface extending from the bottom padding surface to the back padding surface;

a padding cover having a continuous top surface, the padding cover sized and shaped to at least partially cover the padding assembly and to hold the padding assembly in a geometric shape, the padding cover including:

a central cover portion sized and shaped to cover the angled padding surface and at least a portion of the top surface of the mattress that is not covered by the padding assembly;

a side cover portion connected to and circumscribing the central cover portion and sized and shaped to at least partially wrap around the padding assembly; and releasable cover fasteners structured to releasably fasten the side cover portion directly to the padding assembly; and a fitted sheet sized and shaped to completely cover the padding assembly and the padding cover and to hold the padding assembly and the padding cover to the mattress, the fitted sheet having:

a padding covering portion sized and shaped to cover the padding cover; and a mattress covering portion having a first sheet part extending from the padding covering portion and sized and shaped to cover the circumscribing sidewall of the mattress, and a second sheet part extending from the first sheet part, the second sheet part having an elastic portion sized and shaped to at least partially cover the bottom surface of the mattress and to urge the padding assembly and the padding cover onto the top surface of the mattress.

2. The padding system of claim 1, wherein the padding assembly further comprises:

a first padding portion configured to be positioned on a first edge of the top surface of the mattress;

a second padding portion configured to be positioned on a second edge of the top surface of the mattress, the second padding portion lying adjacent to the first padding portion;

a third padding portion being configured to be positioned on a third edge of the top surface of the mattress, the third padding portion lying adjacent to the second padding portion; and a fourth padding portion being configured to be positioned on a fourth edge of the top surface of the mattress, the fourth padding portion lying adjacent to the third padding portion and the first padding portion.

3. The padding system of claim 1, wherein the padding assembly is polyethylene.

4. The padding system of claim 1, wherein the padding covering portion of the fitted sheet is organic cotton.

5. The padding system of claim 1, wherein the padding cover is organic cotton.

6. The padding system of claim 1, wherein the padding cover further comprises a rubber layer.

7. The padding system of claim 1, wherein padding covering portion of the fitted sheet further comprises:

a center portion sized and shaped to cover at least a portion of the top surface of the mattress; and a perimeter portion connected to the center portion and sized and shaped to cover the padding assembly.

8. A bedding assembly for a mattress having a top surface with a surface area, which defines a perimeter of the mattress, and a bottom surface, the assembly comprising:

a padding sized and shaped to rest on the top surface of a mattress and be secured around the perimeter of the mattress, the padding having first, second, third, and fourth padding sections;

a cover having a continuous top surface and sized and shaped to lie on top of and enclose the padding and cover the top surface area of the mattress, the cover including:

a first padding wrap sized and shaped to enclose the first section of the padding, the first padding wrap having a first releasable fastener structured to releasably fasten the first padding wrap directly to the first section of the padding;

a second padding wrap sized and shaped to enclose the second section of the padding, the second padding wrap having a second releasable fastener structured to releasably fasten the second padding wrap directly to the second section of the padding;

a third padding wrap sized and shaped to enclose the third section of the padding, the third padding wrap having a third releasable fastener structured to releasably fasten the third padding wrap directly to the third section of the padding;

a fourth padding wrap sized and shaped to enclose the fourth section of the padding, the fourth padding wrap having a fourth releasable fastener structured to releasably fasten the fourth padding wrap directly to the fourth section of the padding; and a center section connected to the first padding wrap, the second padding wrap, the third padding wrap and the fourth padding wrap, the center section sized and shaped to securely hold the first padding wrap, the second padding wrap, the third padding wrap and the fourth padding wrap together and to cover a portion of the top surface of the mattress that is not covered by the padding.

9. The bedding assembly of claim 8, further comprising:

a fitted sheet sized and shaped to completely cover the padding and the cover and to hold the padding and the cover to the top surface of the mattress, the fitted sheet having:

a center portion sized and shaped to completely cover the top surface of the mattress;

a raised perimeter portion connected to the center portion and sized and shaped to lie adjacent to and on top of the padding; and a sidewall portion configured to enclose the padding, the cover and a portion of the bottom surface of the mattress and to hold the padding and the cover to the top surface of the mattress.

10. The bedding assembly of claim 8, wherein:

the first padding section has a bottom surface, a back surface, an angled surface extending from the bottom surface to the back surface, a first side surface and a second side surface;

the second padding section has a bottom surface, a back surface, an angled surface extending from the bottom surface to the back surface, a first side surface and a second side surface, the first side surface of the second padding section being configured to be positioned adjacent to the second side surface of the first padding section;

the third padding section has a bottom surface, a back surface, an angled surface extending from the bottom surface to the back surface, a first side surface and a second side surface, the first side surface of the third padding section configured to be positioned adjacent to the second side surface of the second padding section;

the fourth padding section has a bottom surface, a back surface, an angled surface extending from the bottom surface to the back surface, a first side surface and a second side surface, the first side surface of the fourth padding section configured to be positioned adjacent to the second side surface of the third padding section, and the second side surface of the fourth padding section configured to be positioned adjacent to the first side surface of the first padding section;

wherein the first, second, third, and fourth padding sections define a raised perimeter circumscribing a planar central section to create a completely padded environment for an infant or a child.

11. A bedding system, comprising:

a mattress having a top surface, a bottom surface, a thickness, and a sidewall that defines a perimeter of the top surface of the mattress;

a padding assembly positioned on the perimeter of the top surface of the mattress, the padding assembly having:

a back surface substantially parallel to the sidewall surface of the mattress;

a bottom surface perpendicular to the back surface and extending inward from the back surface toward a center of the top surface of the mattress;

an angled surface extending from the back surface to the bottom surface, the angled surface extending inward from the back surface toward the center of the top surface of the mattress; and an open center region defined by the connection of the angled surface and the top surface around the perimeter of the mattress; and a cover having a continuous top surface and sized and shaped to lie on top of and enclose the padding assembly and to cover the top surface of the mattress, the cover including:

a first padding wrap sized and shaped to enclose a first section of the padding;

a second padding wrap sized and shaped to enclose a second section of the padding;

a third padding wrap sized and shaped to enclose a third section of the padding;

a fourth padding wrap sized and shaped to enclose a fourth section of the padding; and a center section connected to the first padding wrap, the second padding wrap, the third padding wrap and the fourth padding wrap, the center section sized and shaped to securely hold the first padding wrap, the second padding wrap, the third padding wrap and the fourth padding wrap together, the center section covering a portion of the top surface of the mattress that is not covered by the padding assembly; and a fitted sheet sized and shaped to enclose the padding assembly and the mattress and to tightly fit over and conform to the padding assembly and the mattress, and to hold the padding assembly to the top surface of the mattress.

12. The bedding system of claim 11, wherein the fitted sheet further comprises:

a center portion sized and shaped to cover the open center region;

a raised perimeter portion surrounding the center portion and sized and shaped to cover the padding assembly; and a side portion connected to the raised perimeter portion and configured to fit over and at least partially enclose the mattress.

* * * * *